US007654795B2

(12) United States Patent
Tibbott

(10) Patent No.: US 7,654,795 B2
(45) Date of Patent: Feb. 2, 2010

(54) TURBINE BLADE

(75) Inventor: Ian Tibbott, Lichfield (GB)

(73) Assignee: Rolls-Royce plc, London (GB)

( * ) Notice: Subject to any disclaimer, the term of this patent is extended or adjusted under 35 U.S.C. 154(b) by 489 days.

(21) Appl. No.: 11/591,615

(22) Filed: Nov. 2, 2006

(65) Prior Publication Data

US 2009/0081024 A1 Mar. 26, 2009

(30) Foreign Application Priority Data

Dec. 3, 2005 (GB) ..... 0524735.8

(51) Int. Cl.
*F01D 5/08* (2006.01)
*F01D 5/18* (2006.01)

(52) U.S. Cl. ..... 416/97 R; 415/115; 415/121.3; 415/169.1; 416/96 R; 416/97 A

(58) Field of Classification Search ..... 415/115, 415/121.1, 121.2, 121.3, 169.1; 416/92, 416/96 R, 97 R, 97 A
See application file for complete search history.

(56) References Cited

U.S. PATENT DOCUMENTS 4,105,364 A * 8/1978 Dodd ..... 416/97 R
4,775,296 A * 10/1988 Schwarzmann et al. ... 416/97 R
4,786,233 A * 11/1988 Shizuya et al. ..... 416/97 R
4,820,122 A * 4/1989 Hall et al. ..... 416/97 R
4,820,123 A * 4/1989 Hall ..... 416/97 R
5,827,043 A * 10/1998 Fukuda et al. ..... 415/121.2
6,347,923 B1 * 2/2002 Semmler et al. ..... 416/97 R

FOREIGN PATENT DOCUMENTS

| | | |
|---|---|---|
| EP | 0 230 917 A3 | 8/1987 |
| EP | 0 340 149 A1 | 11/1989 |
| GB | 1 564 608 A | 4/1980 |
| GB | 2 112 467 A | 7/1983 |
| GB | 2 262 314 A | 6/1993 |
| GB | 2 349 920 A | 11/2000 |

* cited by examiner

*Primary Examiner*—Igor Kershteyn
(74) *Attorney, Agent, or Firm*—Oliff & Berridge, PLC

(57) ABSTRACT

An aerofoil for a gas turbine engine, the aerofoil comprises a leading edge and a trailing edge, pressure and suction surfaces and defines therebetween an internal passage for the flow of cooling fluid therethrough. A particle deflector means is disposed within the passage to deflect particles within a cooling fluid flow away from a region of the aerofoil susceptible to particle buildup and subsequent blockage, such as a cooling passage for a shroud of a blade.

5 Claims, 5 Drawing Sheets

TURBINE BLADE

The present invention relates to cooling arrangements within turbine aerofoil components in a gas turbine and in particular to providing means of preventing particle build up in regions susceptible to blockage.

It is conventional good practice to provide a 'dust-hole'0 in the tip location of radial passages of a rotor blade cooling scheme to allow particles, ingested with the cooling air, to escape from the blade. However, as more complex cooling passage geometry is used in the blade tip, especially where a blade shroud is present, the particles block can still block the cooling air passages. In prior art designs these foreign particles are centrifuged into the radially outer tip sections of the passages. Some of the particles adhere to the hot internal end-walls and build up layer upon layer over time adding weight to the blades and progressively restricting the passage of cooling air. If the shroud of the blade is cooled this dirt can find its way into the small diameter cooling passages and holes, and will eventually build up and cause the holes to become partially or in some cases completely blocked. When the cooling passages and holes become blocked the component will inevitably become overheated, and will eventually fail in creep, creep-fatigue or oxidation. Obviously, this is an undesirable situation and every opportunity is taken to avoid the component from being blocked. Hence dust holes are introduced into the tips of the blade passages to allow the dirt to pass out of the passages and into the mainstream gas path. However, dust holes cannot be used where the outlet gas path static pressure is greater than the static pressure within the blade, as this would result in hot mainstream gas flowing into the blade. For this reason dust holes typically only exist downstream of the second labyrinth fin seal (see prior art FIG. 2). However this leaves the leading edge passage tip region and the shroud cooling scheme susceptible to particle buildup.

Therefore it is an object of the present invention to provide a deflection means of deflecting the particles from the leading edge tip region towards the downstream dust hole. These deflector means change the trajectory of any particles, which are denser than that of the cooling fluid, directing them away from the entrance to shroud cooling feed passages. The invention aims to prevent foreign particles from building up in the tips of the radial passages and shroud cooling scheme, ultimately extending the useful life of the component.

In accordance with the present invention an aerofoil for a gas turbine engine comprises a leading edge and a trailing edge, pressure and suction surfaces and defines therebetween an internal passage for the flow of cooling fluid therethrough characterised in that a particle deflector means is disposed within the passage to deflect particles within a cooling fluid flow away from a region of the aerofoil susceptible to particle buildup and subsequent blockage.

Preferably, the particle deflector means is arranged to deflect particles towards a dust hole defined in the aerofoil.

Preferably, the particle deflector means is arcuate and is concave with respect to the particles striking it.

Preferably, the particle deflector means comprises a deflector wall extending between the leading edge and the trailing edge.

Preferably, the particle deflector wall is integral with the leading edge wall.

Alternatively, a gap is defined between the particle deflector wall and the leading edge wall.

Preferably, a land is disposed to the leading edge wall upstream of the gap with respect to the direction of cooling flow, such that particles striking the land are deflected away from the gap.

Alternatively, the particle deflector wall is segmented and arranged in overlapping formation with respect to the direction of cooling flow, such that particles striking one or more of the segments are deflected away from the region of the aerofoil susceptible to particle buildup and subsequent blockage.

Preferably, each segment is arcuate.

Preferably, the aerofoil comprises an internal surface radially outward of the deflection means, the surface comprises a portion which is angled radially outwardly such that at least some of the particles deflected by the deflection means, strike the internal surface and are further deflected away from the region of the aerofoil susceptible to particle buildup and subsequent blockage.

Preferably, the region susceptible to particle build up and subsequent blockage is a cooling hole defined in the aerofoil.

Preferably, the particle deflector means is arranged to deflect particles away from the leading edge towards the downstream edge.

Preferably, the aerofoil comprises a shroud portion, the shroud portion defines the cooling hole.

Preferably, the entry to the cooling hole is nearer the leading edge than the entry to the dust hole.

Preferably, the aerofoil comprises at least one radially extending fin mounted on a radially outer part of the aerofoil.

Preferably, the outlet of the cooling hole is downstream of the at least one radially extending fin.

Preferably, the outlet of the dust hole is downstream of at least one radially extending fin.

Preferably, the aerofoil is any one of the group comprising a blade or a vane.

Preferably, a gas turbine comprises an aerofoil as described in any one of the above paragraphs.

The present invention will be more fully described by way of example with reference to the accompanying drawings in which.

Figure 1:
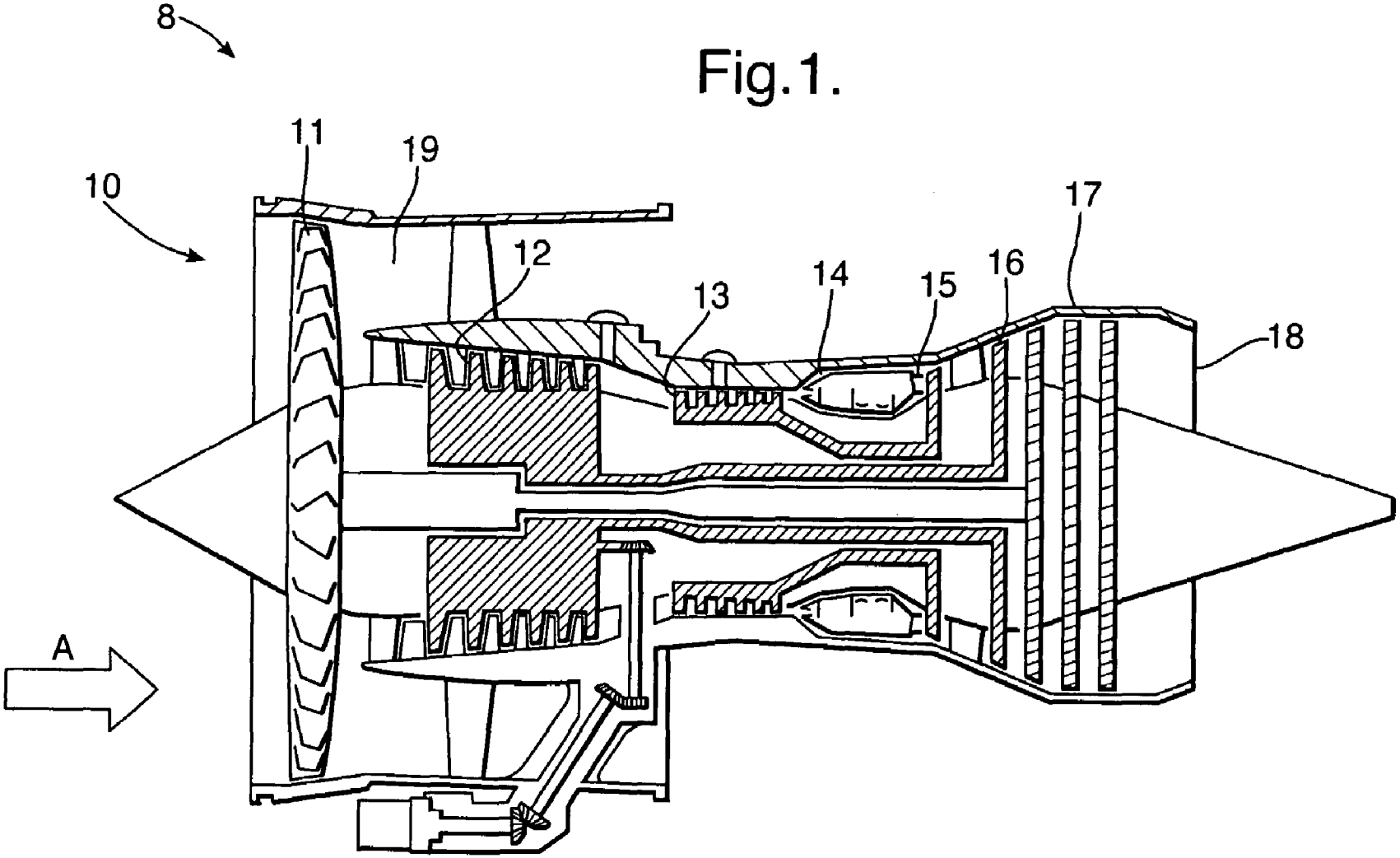
FIG. 1 is a schematic of a three shaft gas turbine engine.

With reference to FIG. 1, a ducted fan gas turbine engine 8 comprises, in axial flow series, an air intake 10, a propulsive fan 11, an intermediate pressure compressor 12, a high-pressure compressor 13, combustion chamber 14, a high-pressure turbine 15, and intermediate pressure turbine 16, a low-pressure turbine 17 and an exhaust nozzle 18.

The gas turbine engine works in a conventional manner so that air entering the intake 10 is accelerated by the fan 11 to produce two air flows: a first air flow into the intermediate pressure compressor 12 and a second air flow which passes through a bypass duct 19 to provide propulsive thrust. The intermediate pressure compressor 14 further compresses the air flow directed into it before delivering that air to the high pressure compressor 13 where still further compression takes place.

The compressed air exhausted from the high-pressure compressor 13 is directed into the combustion equipment 14 where it is mixed with fuel and the mixture combusted. The resultant hot combustion products then expand through, and thereby drive the high, intermediate and low-pressure turbines 15, 16, 17 before being exhausted through the nozzle 18 to provide additional propulsive thrust. The high, intermediate and low-pressure turbines 15, 16, 17 respectively drive the high and intermediate pressure compressors 13, 12 and the fan 11 by suitable interconnecting shafts. The arrow A represents the airflow into the engine and the general direction that the main airflow will travel there through. The terms upstream and downstream relate to this direction of airflow unless otherwise stated.

Figure 2:
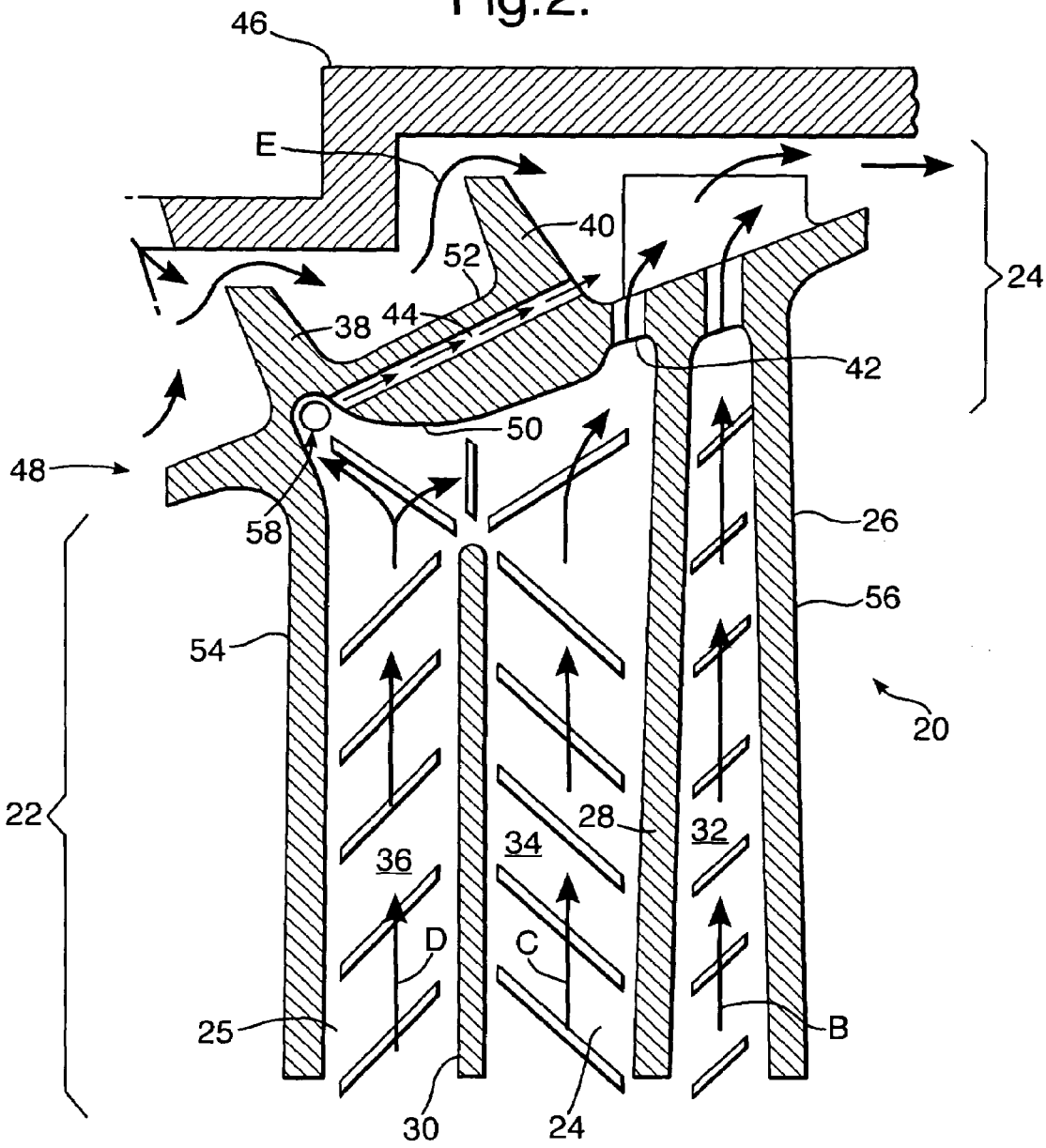
FIG. 2 is a section through of a prior art turbine blade detailing the shroud and internal cooling passage.

An exemplary embodiment of the present invention is shown in FIG. 2 where a conventional intermediate pressure turbine (IPT) blade 20 has a conventional root portion (not shown), an aerofoil portion 22 and radially outwardly a shroud 24. External wall 26 and two internal walls 28, 30 define three internal and generally radially extending passages 32, 34, 36. The shroud comprises shroud fins 38, 40 and defines a dust hole 42 and a shroud cooling hole 44. The external wall 26 forms the aerodynamic gas-wash surfaces of the blade 20 and therefore defines a suction surface and pressure surface, not shown in the figures but readily understood by the skilled artisan.

It should be readily understood that the blade 20 is one of an array of radially extending blades forming a rotor stage of the IPT 16. A turbine casing 46 closely surrounds the ITP 16 and cooperates with the array of blades to ensure minimal gas leakage over the shroud fins 38, 40 during engine operation.

During engine operation cooling fluid, in this case air bled from an engine compressor, is directed into the blade 20 through the root portion and into the aerofoil portion 22, in direction of arrows B, C and D, and through the internal passages 32, 34 and 36 respectively. The cooling fluid often carries small particles of foreign matter such as dirt, sand and oil. These particles can be very fine, but are denser than the cooling air they are travelling in and are hence centrifuged into a radially outer tip region 48 of the blade 20. These particles can adhere to the hot internal surfaces 50 and build up layer upon layer over time adding weight to the blade and progressively restricting the passage of cooling air. If the shroud 24 of the blade 20 is cooled, as in this case, the shroud cooling hole 44 passes coolant downstream along its passage hence cooling the shroud's 24 external surface 52 before venting the coolant downstream of a second fin 40.

The dust hole 42 is incorporated into the tip of the blade passage 34 to allow foreign particles to pass into the over-tip gas path E before joining the main gas flow path through the turbine. During operation, there is a reduction in the static pressure gradient between leading and trailing edges 54, 56 of the blade 20 as the turbine stage extracts work from the main gas flow. Thus the exit of the dust hole 42 may not be located too near the leading edge 54 of the blade 20 where there is a greater static pressure. If the static pressure in the over-tip gas path E is greater than that in the cooling passage 34, then it is impossible to vent the passage, as the negative pressure gradient would cause hot mainstream gases to enter the blade cooling passages 32, 34 and 36 through the dust hole 42 and accelerate the failure mechanism.

For similar reasons, it is preferable for the cooling hole 44 to exit downstream of the second labyrinth fin seal 40. However, the inlet to the cooling hole 44, via a gallery 58, is near to the leading edge 54 in order to provide cooling throughout the shroud 24. Typically there will be an array of cooling holes arranged into and out of FIG. 2, each fed from the gallery 58.

Figure 3:
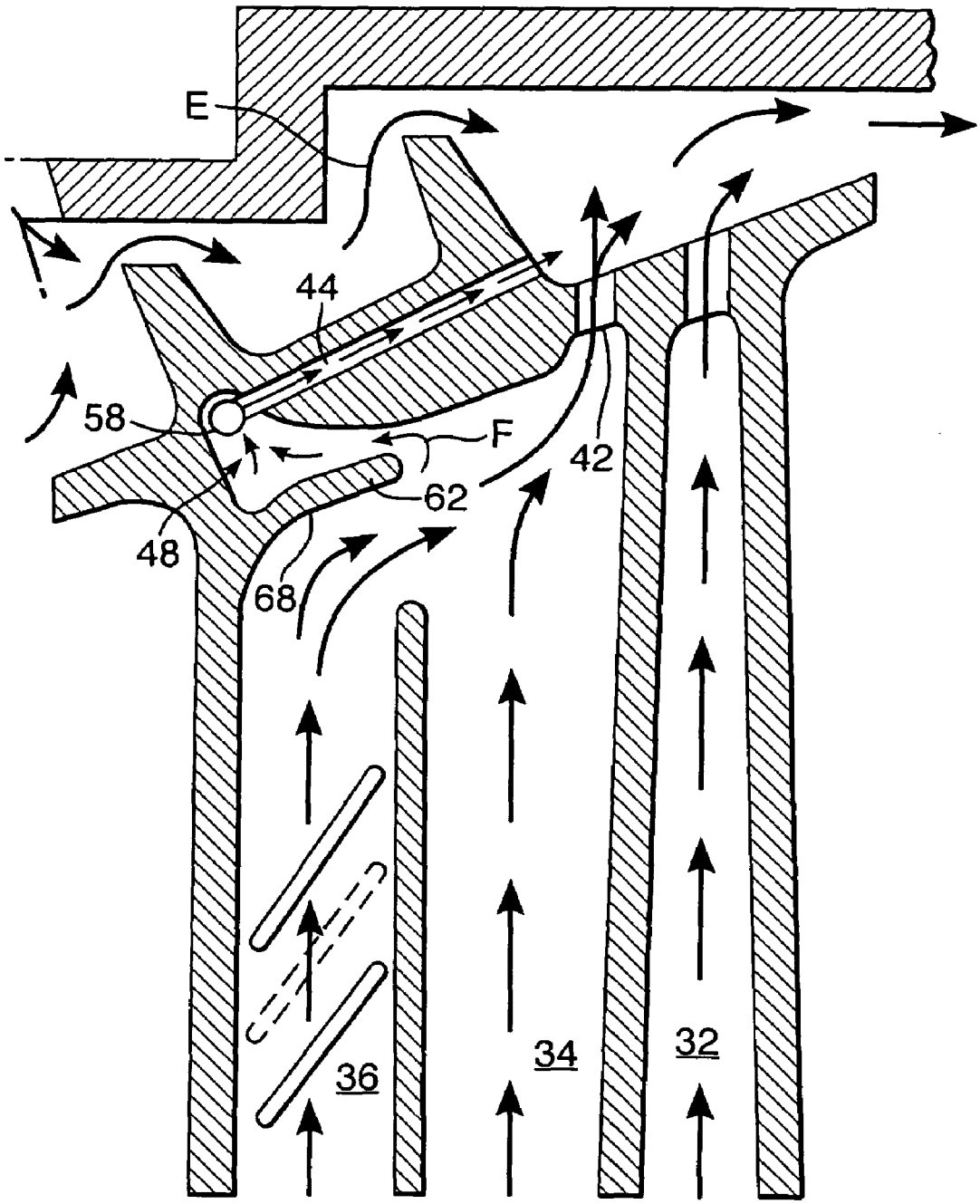
FIG. 3 is section through a turbine blade similar to FIG. 2, and incorporating a first embodiment of the present invention.

Referring to FIG. 3 where like parts are referenced as in FIG. 2, in order to prevent particulate contamination of the leading edge passage tip region 48, the present invention introduces a deflection means 60 to direct any foreign particles towards the downstream dust hole 31 and hence away from region 48. The deflection means 60 comprises a deflector wall 62, which is disposed in the leading edge cooling passage 36, partly obstructing the coolant flow. The deflector wall 62 extends between the blade leading edge and the dust hole 42. The deflector 62 also spans between pressure and suction surface walls i.e. into and out of the figure. In operation the cooling flow, carrying the heavier-than-air foreign particles, impinges on the deflector wall 62 and is redirected towards the downstream dust hole 42. The particles are sufficiently heavy compared to the air to be ejected through the dust hole 42; however, some of the cooling air will follow gas flow path arrow F and exit the cooling passage 36, 34 and enter the cooling hole 44.

Figure 4:
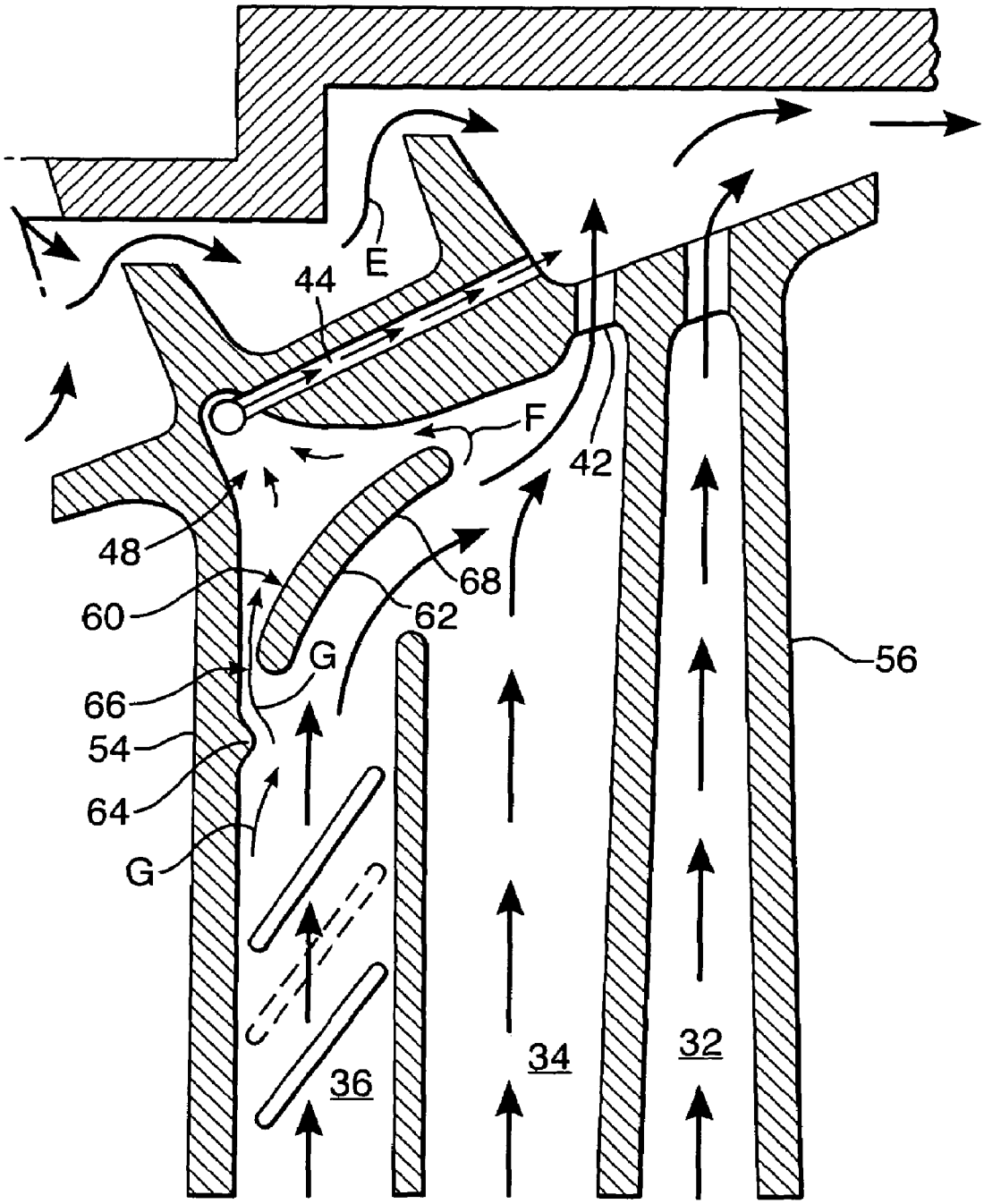
FIG. 4 is section through a turbine blade similar to FIG. 2, and incorporating the present invention in a second embodiment.

Referring to FIG. 4 where like parts are referenced as in FIGS. 2 and 3, a second flow path is provided (arrows G) to allow air to pass through a gap 66 defined between the deflector wall 62 and the leading edge wall 54. To separate the airflow and particulates in the second flow path G, the deflection means 60 comprises a deflector land 64 formed on the passage wall leading edge 54. The land 64 extends into the passage 36 sufficiently far so that particles that would otherwise pass straight through the gap 66 strike the land 64 and are forced toward the deflector wall 62 and 64. Airflow G then passes around the land 64, through the gap 66 and into the cooling holes 44.

Figure 5:
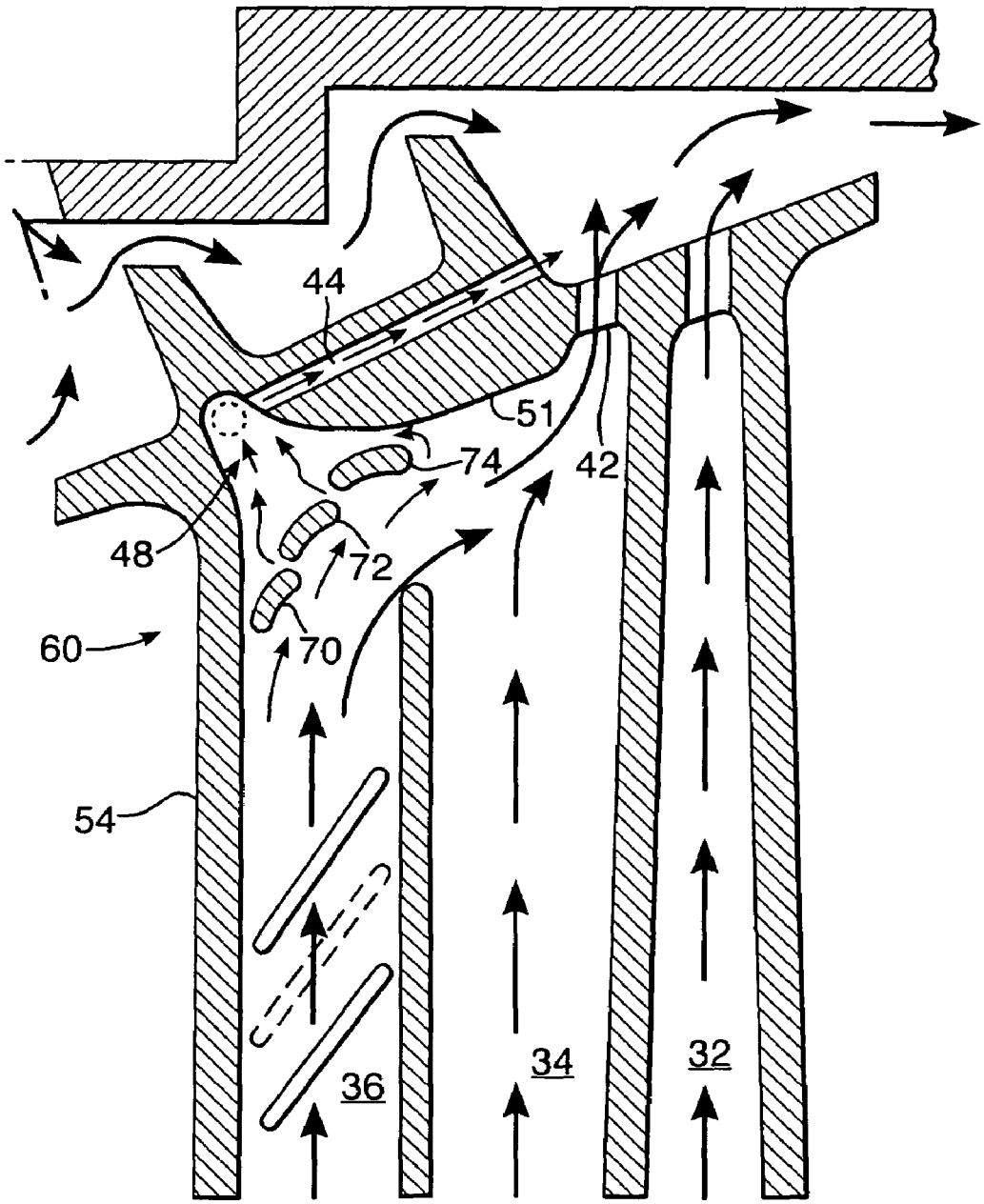
FIG. 5 is section through a turbine blade similar to FIG. 2, and incorporating the present invention in a third embodiment.

Referring to FIG. 5 where like parts are referenced as in FIGS. 2-4, a third embodiment of the deflection means 60 comprises a series of smaller wall segments 70, 72 and 74. The series of wall segments are arranged to overlap one another with respect to particles travelling along the passage 36. The overlap is sufficient to ensure substantially all the particles do not escape between the segments. The segments 70, 72, 74 themselves are arcuate and collectively provide an overall arcuate shape to the deflector wall 60 similar to the single larger deflector wall 62 referred to and shown in FIGS. 3 and 4. This segmented deflector wall 60 increases the amount of cooling gas to the gallery 58 and therefore cooling holes 44.

Although FIG. 5 shows three segments there could be any number of segments making up the deflector wall 60, depending on blade configuration and coolant flow requirements.

The skilled person should appreciate that the deflector wall 62 (or segments 70, 72, 74) may extend further towards the trailing edge 56, across the middle passage 34 such that particles in the second passage are also sufficiently deflected towards the dust hole 42.

Preferably the deflector wall 60 is arcuate, presenting a generally concave surface 68 to improve the turning effect and direction for the particles striking it. Otherwise the wall 62 may be straight.

A further advantage of the present invention is that the blade or aerofoil 20 comprises an angled internal surface 51 disposed radially outward of the deflection means 60. The surface 51 comprises a portion 51 which is angled radially outwardly such that at least some of the particles deflected by the deflection means 60, strike the internal surface 51 and are further deflected away from the region 48 of the aerofoil 20 susceptible to particle buildup and subsequent blockage. It should be noted that particles travelling along the second passage 34 will predominantly strike this angled surface 51 and therefore will be directed away from the region 48 and towards the dust hole 42.

Features of the three embodiments may be combined to provide further configurations, such as the first segment 70 shown in FIG. 5 is integral with the leading edge wall 54.

It should be apparent to the skilled person that the present invention is equally applicable to a compressor or turbine blade (or other aerofoil structure such as a vane) having only one or two cooling passages (32, 34, 36), or even with four or more cooling passages.

The invention claimed is:

1. An aerofoil for a gas turbine engine, the aerofoil comprising:

a leading edge; and a trailing edge;

pressure and suction surfaces; and defines therebetween an internal passage for a flow of cooling fluid therethrough, wherein the internal passage contains a particle deflector to deflect particles within the flow of cooling fluid away from a region of the aerofoil susceptible to particle buildup and subsequent blockage, wherein the region of the aerofoil susceptible to particle buildup and subsequent blockage is a cooling hole defined in the aerofoil, wherein the aerofoil comprises a shroud portion, wherein the shroud portion defines the cooling hole.

2. An aerofoil for a gas turbine engine, the aerofoil comprising:

a leading edge; and a trailing edge;

pressure and suction surfaces; and defines therebetween an internal passage for a flow of cooling fluid therethrough, wherein the internal passage contains a particle deflector to deflect particles within the flow of cooling fluid away from a region of the aerofoil susceptible to particle build up and subsequent blockage, wherein the region of the aerofoil susceptible to particle buildup and subsequent blockage is a cooling hole defined in the aerofoil, wherein the entry to the cooling hole is nearer the leading edge than an entry to a dust hole.

3. An aerofoil for a gas turbine engine, the aerofoil comprising:

a leading edge; and a trailing edge;

pressure and suction surfaces; and defines therebetween an internal passage for a flow of cooling fluid therethrough, wherein the internal passage contains a particle deflector to deflect particles within the flow of cooling fluid away from a region of the aerofoil susceptible to particle build up and subsequent blockage, wherein the aerofoil comprises at least one radially extending fin mounted on a radially outer part of the aerofoil.

4. An aerofoil as claimed in claim 3, wherein an outlet of a cooling hole is downstream of the at least one radially extending fin.

5. An aerofoil as claimed in claim 3, wherein an outlet of a dust hole is downstream of at least one radially extending fin.

* * * * *